US009613528B2

(12) United States Patent
Duan et al.

(10) Patent No.: US 9,613,528 B2
(45) Date of Patent: Apr. 4, 2017

(54) VEHICLE POSITION INDEXING

(71) Applicant: International Business Machines Corporation, Armonk, NY (US)

(72) Inventors: Ning Duan, Beijing (CN); Peng Ji, Beijing (CN); Yi Qi, Shanghai (CN); Ju Yuan, Shanghai (CN); Qian Kun Zhao, Shanghai (CN); Jun Zhu, Beijing (CN)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 251 days.

(21) Appl. No.: 14/224,147

(22) Filed: Mar. 25, 2014

(65) Prior Publication Data

US 2014/0297167 A1 Oct. 2, 2014

(30) Foreign Application Priority Data

Mar. 28, 2013 (CN) ..... 2013 1 0105390

(51) Int. Cl.
*G08G 1/123* (2006.01)
*G08G 1/01* (2006.01)
*G08G 1/065* (2006.01)

(52) U.S. Cl.
CPC ..... *G08G 1/0112* (2013.01); *G08G 1/065* (2013.01)

(58) Field of Classification Search
CPC ..... G08G 1/123; G01C 21/14; G01C 21/28; G01C 21/30; G01C 21/32
See application file for complete search history.

(56) References Cited

U.S. PATENT DOCUMENTS 5,270,937 A * 12/1993 Link ..... G01C 21/30 340/995.19
2002/0065603 A1* 5/2002 Watanabe ..... G01C 21/30 701/446

(Continued)

FOREIGN PATENT DOCUMENTS

CN 1658190 A 8/2005
CN 102012232 A 4/2011

(Continued)

OTHER PUBLICATIONS

Lin, Dan, "Indexing and Querying Moving Objects Databases", School of Computing, National University of Singapore, 2006, pp. 1, 2, 161, 164.

(Continued)

*Primary Examiner* — Thomas G Black
*Assistant Examiner* — Ce Li
(74) *Attorney, Agent, or Firm* — Cantor Colburn LLP; Mercedes Hobson

(57) ABSTRACT

A method and apparatus for vehicle position indexing. The method includes: obtaining position information of a vehicle in real time, and monitoring a current road segment where the vehicle is located based on the position information and road segment information divided by road network information; in response to having monitored that the vehicle enters into the current road segment, building a road segment index record that includes identification information of the vehicle, identification information of the current road segment, and a time when the vehicle enters into the current road segment; and in response to having monitored that the vehicle leaves the current road segment, adding the time when the vehicle leaves the current road segment, into the road segment index record.

12 Claims, 5 Drawing Sheets

(56) References Cited

U.S. PATENT DOCUMENTS

| | | | | |
|---|---|---|---|---|
| 2007/0225894 | A1* | 9/2007 | Tsukamoto | G08G 1/20 701/117 |
| 2008/0040384 | A1 | 2/2008 | Kuznetsov | |
| 2010/0138140 | A1* | 6/2010 | Okuyama | G08G 1/096822 701/117 |
| 2012/0035798 | A1 | 2/2012 | Barfoot et al. | |
| 2013/0030681 | A1* | 1/2013 | Basnayake | G08G 1/0112 701/119 |

FOREIGN PATENT DOCUMENTS

| | | | |
|---|---|---|---|
| CN | 102298640 | A | 12/2011 |
| CN | 102665164 | A | 9/2012 |
| EP | 0977437 | A2 | 2/2000 |
| KR | 20040092082 | A * | 11/2004 |
| KR | 1020040092082 | A | 11/2004 |
| KR | 100557859 | B1 | 3/2006 |
| WO | WO2008/094029 | A1 | 8/2008 |
| WO | WO2011/075639 | A1 | 6/2011 |

OTHER PUBLICATIONS

Meratnia, Nirvana et al. "Spatiotemporal Compression Techniques for Moving Point Objects", Department of Computer Science, University of Twente, EDBT 2004, pp. 765-782, LNCS 2992, Springer-Vertag Berlin Heidelberg, 2004.

* cited by examiner

401

Determine the current road segment where the vehicle is located based on a static spatial index and the position information, wherein index entries in the static spatial index are determined based on a mapping relation between spatial index items and road segments corresponding to the spatial index items.

VEHICLE POSITION INDEXING

CROSS-REFERENCE TO RELATED APPLICATION

This application claims priority under 35 U.S.C. §119 from Chinese Patent Application No. 201310105390.4 filed Mar. 28, 2013, the entire contents of which are incorporated herein by reference.

BACKGROUND OF THE INVENTION

1. Field of the Invention

The present invention relates to spatial position indexing, and more specifically, to a method and apparatus for vehicle position indexing.

2. Description of the Related Art

With the development of Global Position System (GPS) technology, the vehicle trajectory can be conveniently monitored in real time, which facilitates rapid development of the vehicle spatial position indexing technology. The spatial position indexing technology is widely used in fields such as parking lot, logistic companies and vehicle operating service providers, and the like.

The vehicle position indexing technology generally relates to two kinds of spatial-temporal data: one is static road network data with low update frequency, in which the data amount changes slowly over time and can be preprocessed; the other is real-time data of a vehicle, e.g. GPS data, etc., in which, the update is fast and the data amount grows rapidly with the growth of time; thus it is necessary to store and query massive real-time position information of vehicles.

In order to improve the real-time performance of storing and querying, conventional spatial position indexing technologies, such as grid indexing or R-tree indexing, are introduced into all of the existing spatial position databases. However, these existing index technologies have two big problems: on one hand, the cost for updating and maintaining the index is huge, and especially a big challenge exists in dealing with the storage of massive real-time data; on the other hand, when the data amount is very large, the index itself will become very huge, thereby deteriorating query performance.

Apparently, there is still room for improvement in the existing technology, and it is demanded to provide a technical solution of building a vehicle position index with high efficiency.

BRIEF SUMMARY OF THE INVENTION

The present invention provides a method for building a vehicle position index, including: obtaining position information of a vehicle in real time, and monitoring a current road segment where the vehicle is located based on the position information and road segment information divided by road network information; in response to having monitored that the vehicle enters into the current road segment, building a road segment index record that includes identification information of the vehicle, identification information of the current road segment, and a time when the vehicle enters into the current road segment; and in response to having monitored that the vehicle leaves the current road segment, adding the time when the vehicle leaves the current road segment, into the road segment index record.

According to another aspect of the present invention, there is provided an apparatus for building a vehicle position index, including: an obtaining module configured to obtain position information of a vehicle in real time, and to monitor a current road segment where the vehicle is located based on the position information and road segment information divided by road network information; an index record building module configured to build, in response to having monitored that the vehicle enters into the current road segment, a road segment index record that includes identification information of the vehicle, identification information of the current road segment, and a time when the vehicle enters into the current road segment; and an index record maintaining module configured to add, in response to having monitored that the vehicle leaves the current road segment, the time when the vehicle leaves the current road segment, into the road segment index record.

BRIEF DESCRIPTION OF THE DRAWINGS

Through the more detailed description of exemplary embodiments of the present invention in the accompanying drawings, the above and other objects, features and advantages of the present invention will become more apparent, wherein the same reference generally refers to the same components in the exemplary embodiments of the present invention.

DETAILED DESCRIPTION OF THE PREFERRED EMBODIMENTS

Figure 1:
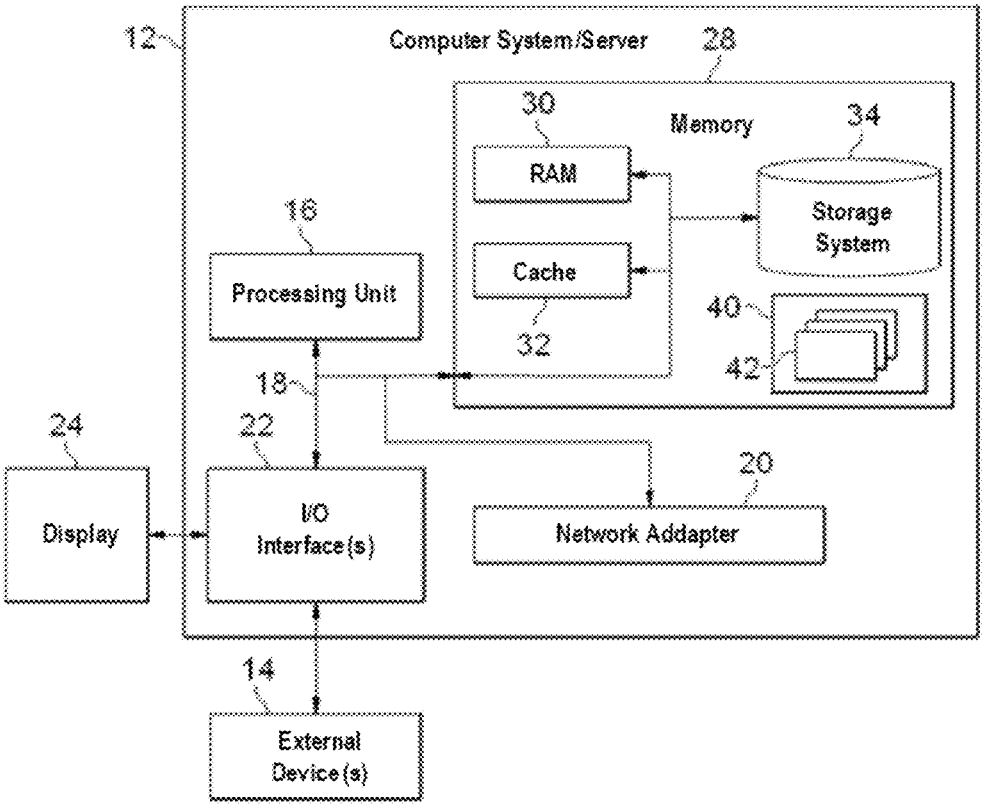
FIG. 1 illustrates a block diagram of an exemplary computer system/server which is applicable to implement the embodiments of the present invention.

Some preferable embodiments will be described in more detail with reference to the accompanying drawings, in which the preferable embodiments of the present invention have been illustrated. However, the present invention can be implemented in various manners, and thus should not be construed to be limited to the embodiments disclosed herein. On the contrary, those embodiments are provided for the thorough and complete understanding of the present invention, and completely conveying the scope of the present invention to those skilled in the art.

As will be appreciated by one skilled in the art, aspects of the present invention can be embodied as a system, method, or computer program product. Accordingly, aspects of the present invention can take the form of an entirely hardware embodiment, an entirely software embodiment (including firmware, resident software, micro-code, etc.) or an embodiment combining software and hardware aspects that can all generally be referred to herein as a "circuit," "module" or "system." Furthermore, in some embodiments, aspects of the present invention can take the form of a computer program product embodied in one or more computer readable medium(s) having computer readable program code embodied thereon.

Any combination of one or more computer readable medium(s) can be utilized. The computer readable medium can be a computer readable signal medium or a computer readable storage medium. A computer readable storage medium can be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium can be any tangible medium that can contain, or store a program for use by or in connection with an instruction execution system, apparatus, or device.

A computer readable signal medium can include a propagated data signal with computer readable program code embodied therein, for example, in baseband or as part of a carrier wave. Such a propagated data signal can take any of a variety of forms, including, but not limited to, an electromagnetic signal, optical signal, or any suitable combination thereof. A computer readable signal medium can be any computer readable medium that is not a computer readable storage medium and that can communicate, propagate, or transport a program for use by or in connection with an instruction execution system, apparatus, or device.

Program code embodied on a computer readable medium can be transmitted using any appropriate medium, including but not limited to wireless, wireline, optical fiber cable, RF, etc., or any suitable combination of the foregoing.

Computer program code for carrying out operations for aspects of the present invention can be written in any combination of one or more programming languages, including an object oriented programming language such as Java, Smalltalk, C++ or the like and conventional procedural programming languages, such as the "C" programming language or similar programming languages. The program code can execute entirely on the user's computer, partly on the user's computer, as a stand-alone software package, partly on the user's computer and partly on a remote computer or entirely on the remote computer or server. In the latter scenario, the remote computer can be connected to the user's computer through any type of network, including a local area network (LAN) or a wide area network (WAN), or the connection can be made to an external computer (for example, through the Internet using an Internet Service Provider).

Aspects of the present invention are described below with reference to flowchart illustrations and/or block diagrams of methods, apparatus (systems), and computer program products according to embodiments of the present invention. It will be understood that each block of the flowchart illustrations and/or block diagrams, and combinations of blocks in the flowchart illustrations and/or block diagrams, can be implemented by computer program instructions. These computer program instructions can be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions can also be stored in a computer readable medium that can direct a computer, other programmable data processing apparatus, or other devices to function in a particular manner, such that the instructions stored in the computer readable medium produce an article of manufacture including instruction means which implements the function/act specified in the flowchart and/or block diagram block or blocks.

The computer program instructions can also be loaded onto a computer, other programmable data processing apparatus, or other devices to cause a series of operational steps to be performed on the computer, other programmable data processing apparatus or other devices to produce a computer implemented process such that the instructions which execute on the computer or other programmable apparatus provide processes for implementing the functions/acts specified in the flowchart and/or block diagram block or blocks.

Referring now to FIG. 1, in which an exemplary computer system/server 12 which is applicable to implement the embodiments of the present invention is shown. Computer system/server 12 is only illustrative and is not intended to suggest any limitation as to the scope of use or functionality of embodiments of the invention described herein.

As shown in FIG. 1, computer system/server 12 is shown in the form of a general-purpose computing device. The components of computer system/server 12 can include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

Computer system/server 12 typically includes a variety of computer system readable media. Such media can be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 can further include other removable/non-removable, volatile/non-volatile computer system storage media. By way of example only, storage system 34 can be provided for reading from and writing to a non-removable, non-volatile magnetic media (not shown in FIG. 1 and typically called a "hard drive"). Although not shown in FIG.

1, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 can include at least one program product having a set (e.g., at least one) of program modules that are configured to carry out the functions of embodiments of the invention.

Program/utility 40, having a set (at least one) of program modules 42, can be stored in memory 28 by way of example, and not limitation, as well as an operating system, one or more application programs, other program modules, and program data. Each of the operating system, one or more application programs, other program modules, and program data or some combination thereof, can include an implementation of a networking environment. Program modules 42 generally carry out the functions and/or methodologies of embodiments of the present invention as described herein.

Computer system/server 12 can also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Figure 2:
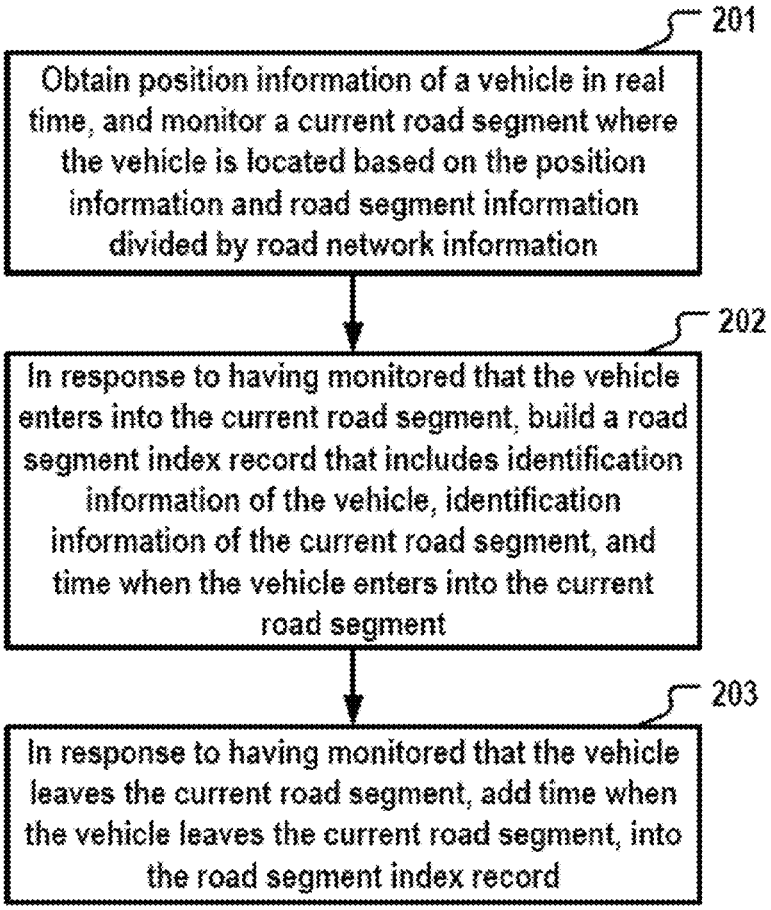
FIG. 2 illustrates a flowchart of a method for building a vehicle position index according to an embodiment of the present invention.

With reference now to FIG. 2, in which a flowchart of a method for building a vehicle position index according to an embodiment of the present invention is shown. As illustrated in FIG. 2, the method includes:

In step 201, position information of a vehicle is obtained in real time, and a current road segment where the vehicle is located is monitored based on the position information and road segment information divided by road network information. In one embodiment of the present invention, the GPS device on a vehicle is used to periodically or non-periodically obtain position information of the vehicle in real time, wherein the road segment information divided by the road network information includes a plurality of road segments and identification information of respective road segments.

The road network information is spatial data from the Geographic Information System (GIS) and has the basic data structure such as edge, node, etc., wherein the node is defined as a crossing point between roads, and the directionality of the road further determines the directed feature of the road segment, and thus the road segment is defined as the directed edge between any two adjacent nodes.

Figure 3A:
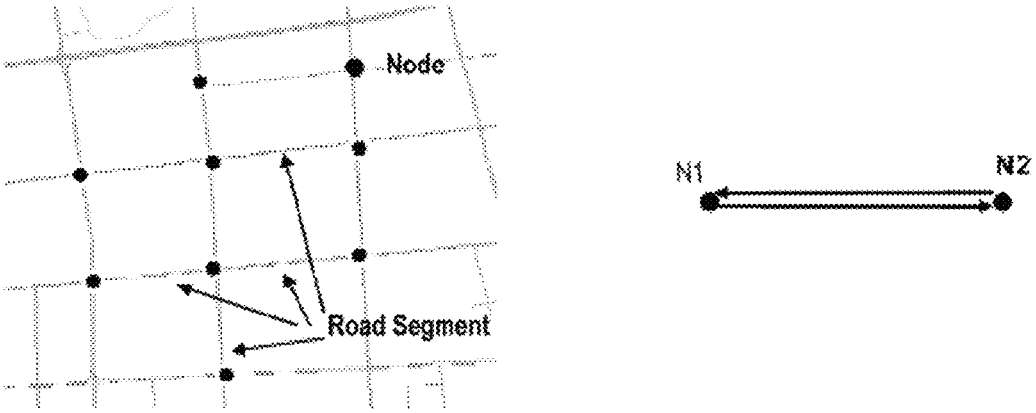
FIG. 3A illustrates a schematic view of road segment division according to an embodiment of the present invention.

FIG. 3A illustrates a schematic view of road segment division according to an embodiment of the present invention. As illustrated in FIG. 3A, black dots represent nodes, and the road between any two adjacent nodes is a road segment. The right diagram in FIG. 3A illustrates the directed feature of the road segment. For example, a two-way street is provided between nodes N1 and N2, and thus two road segments can be divided, i.e. N1→N2, N2→N1. Based on the above definition, those skilled in the art would readily divide road segments based on road network information to thereby obtain road segment information.

According to an embodiment of the present invention, when monitoring the moving of the vehicle between road segments, the current road segment where the vehicle is located can be determined based on the position information so as to match the vehicle position and the road segment.

Figure 3B:
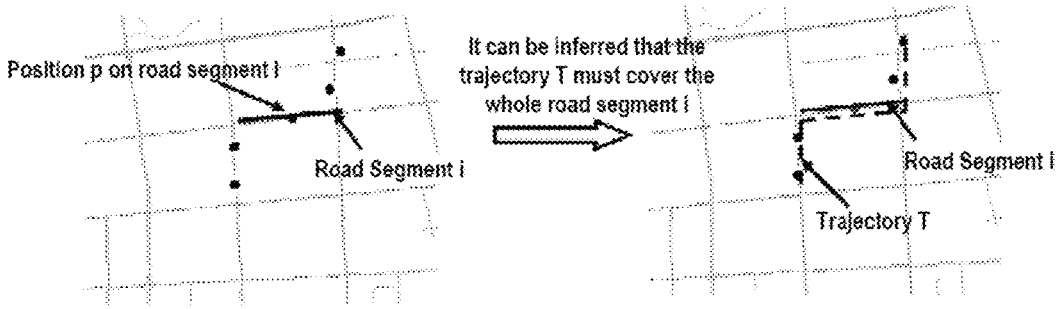
FIG. 3B illustrates a schematic view of a relationship between a vehicle trajectory T and a road segment i according to an embodiment of the present invention.

FIG. 3B illustrates a schematic view of a relationship between a vehicle trajectory T and a road segment i in an embodiment. The following relation always exists among the position information P obtained in real time, the trajectory T of the vehicle and the road segment i: $P \in i, P \in T \Rightarrow i \in T$, that is to say, on the basis that the position point p obtained in real time is located in the road segment i, and the position point p belongs to the trajectory T, it can be inferred that the trajectory T must cover the whole road segment i. Apparently, the moving trajectory of the vehicle is limited by the road segment, and the position information p must be on certain road segment if the error of the GPS data is excluded. Thus, the closed nature of the road segment enables the moving trajectory of the vehicle generally to enter into the road segment from one node and then depart from another node.

In FIG. 2, step 202, in response to having monitored that the vehicle enters into the current road segment, an index record of the current road segment is built, and the index record includes identification information of the vehicle, identification information of the current road segment, and time when the vehicle enters into the current road segment.

For a common road segment, the information described in step 202 needs to be recorded in the index. However, in some specific situations, the trajectory of the vehicle movement will not completely pass through a certain road segment. For example, the start point or end point of the trajectory can be at a certain position in the middle of a road segment. Thus, according to embodiments of the present application, for a road segment including a start point of the trajectory, the method as illustrated in FIG. 2 can further include: in response to having monitored that the vehicle sets off in the middle of the current road segment, building a road segment index record that includes identification information of the vehicle, identification information of the current road segment, and information associated with start of the vehicle in the current road segment. The information associated with start includes, but is not limited to, identification information of the start segment, start position, start time, and start position information. According to another embodiment of the present invention, for a road segment including an end point of the trajectory, the method as illustrated in FIG. 2 can further include: in response to having monitored that the vehicle stops in the middle of the current road segment, building a road segment index record that includes identification information of the vehicle, identification information of the current road segment, and information associated with stop of the vehicle in the current road segment, wherein the information associated with stop includes, but is not limited to, identification information of the stop segment, stop position, stop time, and stop position information.

Figure 3C:
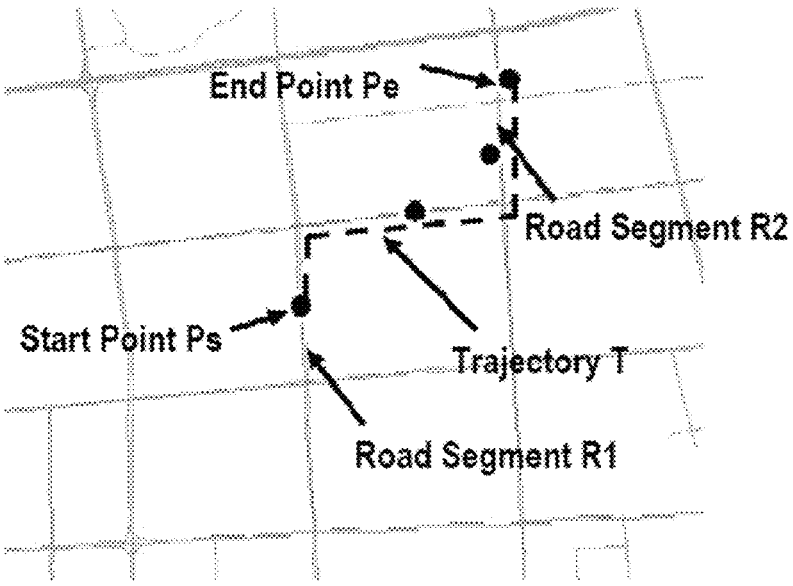
FIG. 3C illustrates a schematic view of a road segment including a start point and an end point of a vehicle trajectory according to an embodiment of the present invention.

FIG. 3C illustrates a schematic view of a road segment including a start point and an end point of a vehicle trajectory according to embodiments of the present invention. Given that Ps is the start point of trajectory T of vehicle M1, located on a road segment R1, and its distance from the start point of R1 is L1, then an index of the road segment where the start point Ps is located can be built: R1, M1, S, L1, t1-t3; and likewise an index of the road segment where the end point Pe is located can also be built: R2, M1, E, L2, t7-t8, wherein S is identification information of the start segment; E is identification information of the end segment; L1 and L2 respectively represent the start position information or stop position information regarding the distance from the start point or the end point to one terminal point of the road segment; t1 is the start time of the vehicle M1 in the road segment R1; t8 is the stop time of the vehicle M1 in the road segment R2. In the subsequent query of spatial data, firstly an index of the start segment of the trajectory or an index of the end segment of the trajectory can be identified based on identification information of the start segment or end segment, and then further screening is performed based on the position information of the start point and the end point and a corresponding, with corresponding query result being returned.

Next, the method in FIG. 2 further includes step 203, in which in response to the vehicle leaving the current road segment, the time when the vehicle leaves the current road segment is added into the index record.

Those skilled in the art understand that when the vehicle enters into a new road segment, the above step is performed repeatedly: in response to the vehicle entering into a new current road segment, an index record of the new current road segment, which includes an identification code of the vehicle, an identification code of the new current road segment, and time when the vehicle enters into the new current road segment, is created; then in response to having monitored that the vehicle leaves the new current road segment, the time when the vehicle leaves the new current road segment is added into the index record of the new road segment.

Using the method as illustrated in FIG. 2, a dynamic position index of a vehicle can be built by establishing a corresponding relation among a road segment, a vehicle and a time interval in which the vehicle passes through the road segment, so as to achieve the technical effects of improving the index building efficiency and compressing the amount of index data.

Figures 4, 5:
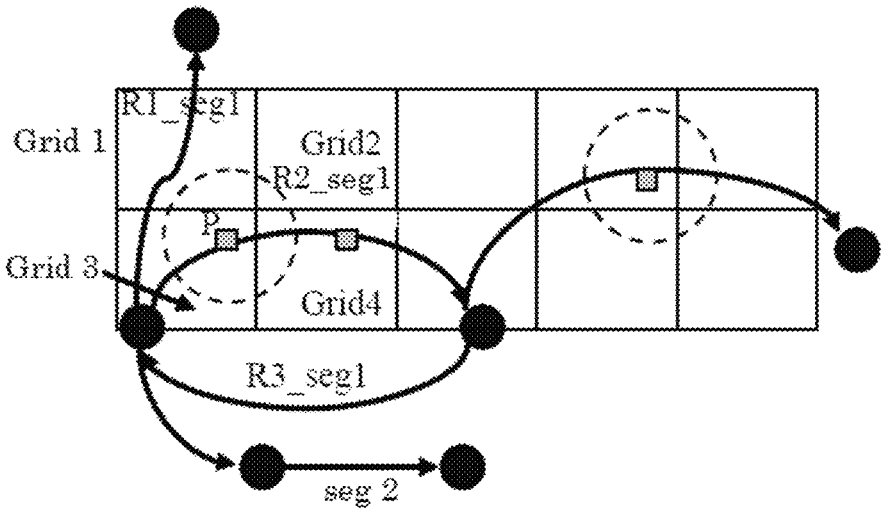
FIG. 4 illustrates an embodiment of the present invention described in step 201 in FIG. 2.
FIG. 5 illustrates a schematic view of vehicle road segment matching according to embodiments of the present invention.

FIG. 4 illustrates one embodiment of step 201 in FIG. 2. The matching process between a vehicle position and a road segment can be accelerated by a road segment-based static spatial index of the road network information, to thereby improve the efficiency for building a vehicle dynamic position index. This embodiment specifically includes step 401.

In step 401, the current road segment where the vehicle is located is determined based on a static spatial index and position information, wherein index entries in the static spatial index are determined based on a mapping relation between spatial index items and road segments corresponding to the spatial index items.

The road segment-based static spatial index refers to a corresponding relation between each space division and its associated road segment as built in accordance with certain spatial division in road network information serving as the foregoing spatial index items. Since the road network information is a kind of static, offline data, with less update, such a spatial index is called a static spatial index.

Specifically speaking, space division is executed on road network information based on the existing spatial index technology to obtain the spatial index items, e.g. the space dividing manner based on a grid, or based on an R-tree, a KD-tree, etc.

When the space division is based on the existing grid index, the spatial index item is a grid, and the mapping relation is a mapping relation between a grid and corresponding road segment(s) in the grid. A grid-based static road segment index is to divide the index space into equal or unequal grids and to record the road segments included in each grid. In comparison, what is built in the prior art is a mapping relation between a grid and specific spatial position points, while what is built in this embodiment of the present invention is a mapping relation between a grid and its associated road segment(s).

When the space division is based on the existing R-tree and KD-tree, each spatial index item is a leaf node of the tree, and the mapping relation is a mapping relation between one of the leaf nodes and corresponding road segment(s) in the leaf node.

By the built static spatial index, the efficiency for searching and matching road segments can be accelerated when matching a vehicle and a road segment. According to an embodiment of the present invention, determining the current road segment where a vehicle is located based on the static spatial index and the position information of the vehicle further includes the following two sub-steps: in sub-step 1, a plurality of candidate spatial index items are determined based on the position information; in sub-step 2, the current road segment where the vehicle is located is determined in road segments associated with the candidate spatial index items. Through the way disclosed by this embodiment of the present invention, a limited number of candidate road segments can be determined rapidly as a candidate set based on the position information of the vehicle and the built index of the static road network, so as to reduce the searching scope.

Taking a grid index as an example, a corresponding candidate grid set can be retrieved based on the obtained real-time position data of a moving object, and further a candidate road segment set can be determined via the candidate grid set. For the same principle, those skilled in the art can extend it to other types of static spatial indexes.

Next, according to a specific embodiment of the present invention, a more specific depiction is made to steps in FIG. 4 by taking a grid index as an example.

In an embodiment of step 401, a spatial data index of static road segments is built according to a corresponding relation between grids and road segments. The spatial index built by the way of this embodiment as shown in Table 1 includes multiple data records each including a spatial index item (e.g. Grid1) and road segment(s) to which the spatial index item corresponds (e.g. road segment R1_Seg1).

TABLE 1

| Grid | Road Segment |
|---|---|
| Grid1 | R1_Seg1 |
| Grid2 | R2_Seg2, |
| Grid3 | R1_Seg1, R2_Seg2 |
| Grid4 | R2_Seg2, |

FIG. 5 illustrates a schematic view of vehicle road segment matching according to embodiments of the present invention. In these embodiments, a position point P of a vehicle is obtained in real time; a circle is determined by taking P as the center with a given distance r as the radius; the grids associated with the circle are added into the candidate set (in this case, the associated grids are Grid1, Grid2, Grid3 and Grid4); corresponding road segments (in this case, Grid1 and Grid3 correspond to a road segment R1_Seg1; and Grid3 and Grid4 correspond to a road segment R2_Seg1) can be retrieved rapidly based on the static road network index built previously and based on these candidate grids, and these road segments form a matched road segment candidate set (i.e. R1_Seg1 and R2_Seg1) of the point P.

Next, the limited number of candidate road segments are analyzed, the specific road segment (e.g. R2_Seg1) where the real-time position data is located can be determined rapidly. It is not difficult to determine a specific road segment where a vehicle is located based on the candidate road segment set, for example, in a specific embodiment, a nearest neighbor method can be employed, i.e. comparing vertical distances from a vehicle position point to respective candidate road segments, and matching the position point to the road segment having the minimum distance. In addition, those skilled in the art can employ other appropriate ways, which are not detailed here.

Figure 6:
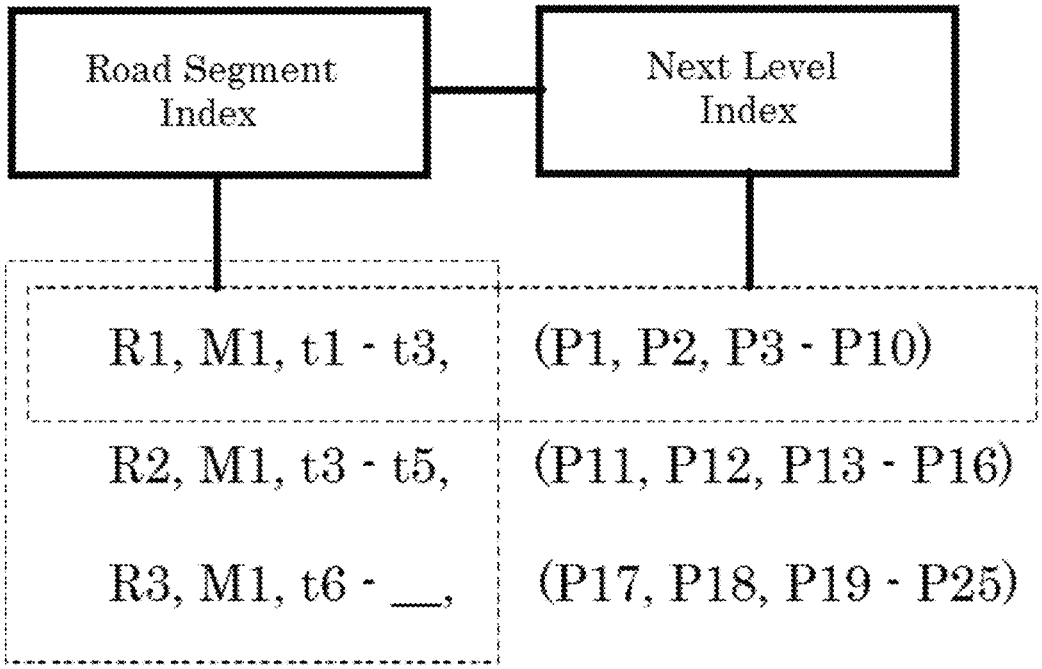
FIG. 6 illustrates a schematic view of an index structure according to an embodiment of the present invention.

Usually, most functions can be achieved by employing the above road segment index. Optionally, the index relation of each road segment and the specific position data corresponding to the road segment can further be included. FIG. 6 illustrates a schematic view of an index structure according to an embodiment. The index structure illustrated in FIG. 6 includes a road segment index [R1, M1, t1, t3], and optionally, it further includes a next level index of the index made to the specific position points (P1, P2, P3 . . . P10) of the vehicle M1 at t1~t3 time. For the same principle, the example illustrated in FIG. 6 further include remaining road segment indexes and corresponding specific position data.

When a road segment is used as a basic spatial unit for building a trajectory dynamic data index, the road segment will become a basic unit for analyzing and querying the trajectory. According to a specific embodiment of the present invention, at least the following four typical spatial-temporal data queries can be implemented:

Given time and identification information of a vehicle, query the position of the vehicle. The time and the identification information of the vehicle are taken as conditions to search for road segments meeting the conditions. Optionally, if a more precise position is to be obtained, a further screening can be carried out in the next level index.

Given identification information and position of a vehicle, query the time when the vehicle passes. A road segment is determined by the position, and a road segment index is retrieved based on the identification information of the vehicle and the road segment, to thereby obtain a corresponding time scope.

Given a spatial and temporal scope, query vehicles meeting the condition. Via the static road network index, index items (e.g. grids) corresponding to a spatial area are obtained, and further the road segments therein are obtained; and then the road segment indexes are filtered based on the road segments and the time scope.

Given a vehicle and time, query vehicles on the same road segment. A corresponding road segment is determined based on the vehicle and the time, and then other vehicles on the same road segment at that moment are determined.

It is not difficult to implement the above four basic query functions based on the built indexes, which is thus not detailed here. It should be understood that those skilled in the art would readily implement by combination other query functions based on the above four basic query functions, which is not detailed here.

Figure 7:
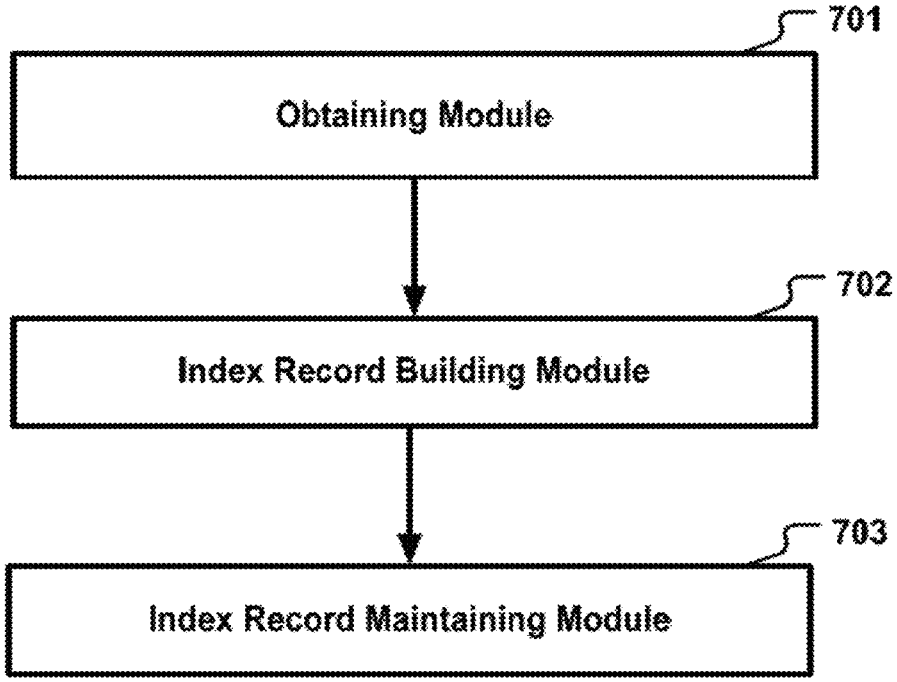
FIG. 7 illustrates a schematic view of an apparatus for building a vehicle position index according to an embodiment of the present invention.

FIG. 7 illustrates an apparatus for building a vehicle position index according to exemplary embodiments of the present invention. The apparatus includes an obtaining module 701, an index record building module 702, and an index record maintaining module 703.

Wherein, the obtaining module 701 is configured to obtain position information of a vehicle in real time, and to monitor a current road segment where the vehicle is located based on the position information and road segment information divided by road network information.

Wherein, the index record building module 702 is configured to build, in response to having monitored that the vehicle enters into the current road segment, a road segment index record that includes identification information of the vehicle, identification information of the current road segment, and time when the vehicle enters into the current road segment.

Wherein, the index record maintaining module 703 is configured to add, in response to having monitored that the vehicle leaves the current road segment, time when the vehicle leaves the current road segment, into the road segment index record.

In an embodiment of the present invention, the obtaining module 701 further includes a module configured to determine the current road segment where the vehicle is located based on a static spatial index and the position information, wherein index entries in the static spatial index are determined based on a mapping relation between spatial index items and road segments corresponding to the spatial index items.

According to embodiments of the present invention, the mapping relation is determined in one of the following ways: if the spatial index items are grids, the mapping relation is a mapping relation between one of the grids and corresponding road segment(s) in the grid; if the spatial index items are leaf nodes of a tree, the mapping relation is a mapping relation between one of the leaf nodes and road segment(s) corresponding to the leaf node.

According to an embodiment of the present invention, wherein the road segment is a road between adjacent nodes, and the nodes are crossing points between roads in the road network information.

According to an embodiment of the present invention, there further includes a module configured to build, in response to having monitored that the vehicle sets off in the middle of the current road segment, a road segment index record that includes identification information of the vehicle, identification information of the current road segment, and information associated with start of the vehicle in the current road segment.

According to another embodiment of the present invention, there further includes a module configured to build, in response to having monitored that the vehicle stops in the middle of the current road segment, a road segment index record that includes identification information of the vehicle, identification information of the current road segment, and information associated with stop of the vehicle in the current road segment.

According to an embodiment of the present invention, the module configured to determine the current road segment where the vehicle is located based on the static spatial index and the position information further includes: a module configured to determine a plurality of candidate spatial index items based on the static spatial index and the position information; a module configured to determine a current road segment where the vehicle is located, in road segments associated with the candidate spatial index items.

The flowchart and block diagrams in the Figures illustrate the architecture, functionality, and operation of possible implementations of systems, methods, and computer program products according to various embodiments of the present invention. In this regard, each block in the flowchart or block diagrams can represent a module, segment, or portion of code, which includes one or more executable instructions for implementing the specified logical function (s). It should also be noted that, in some alternative implementations, the functions noted in the block can occur out of the order noted in the figures. For example, two blocks shown in succession can, in fact, be executed substantially concurrently, or the blocks can sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A computer implemented method for building a vehicle position index, comprising:

obtaining, by a global positioning system (GPS) device, position information of a vehicle in real time;

determining a current road segment where the vehicle is located based on a static spatial index and the position information, wherein index entries in the static spatial index are determined based on a mapping relation between spatial index items and road segments corresponding to the spatial index items;

monitoring a current road segment where the vehicle is located;

responsive to having monitored that the vehicle enters into the current road segment, building a road segment index record that includes identification information of the vehicle, identification information of the current road segment, and a time when the vehicle enters into the current road segment; and responsive to having monitored that the vehicle leaves the current road segment, adding into the road segment index record the time when the vehicle leaves the current road segment.

2. The method according to claim 1, wherein if the spatial index items are grids, the mapping relation is a mapping relation between one of the grids and a corresponding road segment(s) in the grid.

3. The method according to claim 1, wherein if the spatial index items are leaf nodes of a tree, the mapping relation is a mapping relation between one of the leaf nodes and a road segment(s) corresponding to the leaf node.

4. The method according to claim 1, wherein the current road segment is a road between adjacent nodes, and each of the adjacent nodes are crossing points between roads nearest to the current road segment in the road network information.

5. The method according to claim 1, further comprising:

in response to having monitored that the vehicle sets off in the middle of the current road segment, building the road segment index record that includes the identification information of the vehicle, the identification information of the current road segment, and information associated with a start of the vehicle in the current road segment.

6. The method according to claim 1, further comprising:

in response to having monitored that the vehicle stops in the middle of the current road segment, building the road segment index record that includes the identification information of the vehicle, the identification information of the current road segment, and information associated with a stop of the vehicle in the current road segment.

7. An apparatus for building a vehicle position index, comprising:

a global positioning system (GPS) device comprising a processor coupled to a memory, the processor configured to:

obtain position information of a vehicle in real time;

determine a current road segment where the vehicle is located based on a static spatial index and the position information, wherein index entries in the static spatial index are determined based on a mapping relation between spatial index items and road segments corresponding to the spatial index items;

monitor a current road segment where the vehicle is located;

build, in response to having monitored that the vehicle enters into the current road segment, a road segment index record that includes identification information of the vehicle, identification information of the current road segment, and a time when the vehicle enters into the current road segment; and add, in response to having monitored that the vehicle leaves the current road segment, the time when the vehicle leaves the current road segment, into the road segment index record.

8. The apparatus according to claim 7, wherein if the spatial index items are grids, the mapping relation is a mapping relation between one of the grids and a corresponding road segment(s) in the grid.

9. The apparatus according to claim 7, wherein if the spatial index items are leaf nodes of a tree, the mapping relation is a mapping relation between one of the leaf nodes and a road segment(s) corresponding to the leaf node.

10. The apparatus according to claim 7, wherein the current road segment is a road between adjacent nodes, and each of the adjacent nodes are crossing points between roads nearest to the current road segment in the road network information.

11. The apparatus according to claim 7, further comprising:

responsive to having monitored that the vehicle sets off in the middle of the current road segment, building the road segment index record that includes the identification information of the vehicle, the identification information of the current road segment, and information associated with a start of the vehicle in the current road segment.

12. The apparatus according to claim 7, further comprising:

responsive to having monitored that the vehicle stops in the middle of the current road segment, building the road segment index record that includes the identification information of the vehicle, the identification information of the current road segment, and information associated with a stop of the vehicle in the current road segment.

* * * * *